US008734059B2

(12) United States Patent
Taylor

(10) Patent No.: US 8,734,059 B2
(45) Date of Patent: May 27, 2014

(54) SOIL REINFORCING ELEMENT FOR A MECHANICALLY STABILIZED EARTH STRUCTURE

(75) Inventor: Thomas P. Taylor, Colleyville, TX (US)

(73) Assignee: T&B Structural Systems LLC

( * ) Notice: Subject to any disclaimer, the term of this patent is extended or adjusted under 35 U.S.C. 154(b) by 413 days.

(21) Appl. No.: 13/012,680

(22) Filed: Jan. 24, 2011

(65) Prior Publication Data

US 2011/0311317 A1 Dec. 22, 2011

Related U.S. Application Data

(63) Continuation-in-part of application No. 12/837,347, filed on Jul. 15, 2010, and a continuation-in-part of application No. 12/818,011, filed on Jun. 17, 2010.

(51) Int. Cl.

| | |
|---|---|
| ***E02D 3/02*** | (2006.01) |
| ***E02D 5/00*** | (2006.01) |
| ***E02D 17/00*** | (2006.01) |
| ***E02D 29/00*** | (2006.01) |
| ***E02D 29/02*** | (2006.01) |

(52) U.S. Cl.

CPC ..... *E02D 29/0241* (2013.01); *E02D 29/025* (2013.01)

USPC ..... 405/262; 405/284

(58) Field of Classification Search

USPC ..... 405/262, 284, 258.1, 302.4, 302.6, 405/302.7

See application file for complete search history.

(56) References Cited

U.S. PATENT DOCUMENTS

| | | | | |
|---|---|---|---|---|
| 991,041 | A | 5/1911 | Toennes | |
| RE13,299 | E | 10/1911 | Denison | |
| 1,012,008 | A * | 12/1911 | Post | 403/46 |
| 1,144,143 | A * | 6/1915 | McGillivray | 405/20 |
| 1,813,912 | A | 7/1931 | Clark | |
| 1,959,816 | A | 5/1934 | Crum | |
| 1,992,785 | A | 2/1935 | Steuer | |
| 2,137,153 | A | 11/1938 | Brozek | |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.
International Application No. PCT/US09/031494—International Search Report and Written Opinion dated Mar. 13, 2009.
International Application No. PCT/US09/44099—International Search Report and Written Opinion dated Aug. 12, 2009.

(Continued)

*Primary Examiner* — Frederick L Lagman
*Assistant Examiner* — Patrick Lambe
(74) *Attorney, Agent, or Firm* — Edmonds & Nolte, PC

(57) ABSTRACT

A soil reinforcing element for use in a mechanically stabilized earth structure is disclosed. The soil reinforcing element may include a pair of longitudinal wires extending substantially parallel to each other and having a connection end. A plurality of transverse wires is coupled to the pair of longitudinal wires and laterally-spaced from each other, thereby forming a welded wire gridworks. To increase the tensile capacity of the soil reinforcing element and also improve pullout valued from the backfill, the soil reinforcing element is made of positively deformed wire or bar stock. An end connector is coupled to the connection end and facilitates connection of the soil reinforcing element to a vertical facing.

10 Claims, 5 Drawing Sheets

(56) References Cited

U.S. PATENT DOCUMENTS 2,208,589 A 7/1940 Leemhuis
2,275,933 A 3/1942 Werner
2,316,712 A 4/1943 Prince
2,327,640 A 8/1943 Hendry
2,552,712 A 5/1951 Ellis
2,703,963 A 3/1955 Gutierrez
2,881,614 A 4/1959 Preininger
3,316,721 A * 5/1967 Heilig ..... 405/262
3,597,928 A 8/1971 Pilaar
3,680,748 A * 8/1972 Brunhuber ..... 223/98
3,998,022 A 12/1976 Muse
4,075,924 A 2/1978 McSherry
4,116,010 A 9/1978 Vidal
4,117,686 A 10/1978 Hilfiker
4,123,881 A 11/1978 Muse
4,134,241 A 1/1979 Walton
4,193,718 A * 3/1980 Wahrendorf et al. ..... 405/286
4,286,895 A 9/1981 Poli
4,324,508 A 4/1982 Hilfiker
4,329,089 A * 5/1982 Hilfiker et al. ..... 405/262
4,341,491 A 7/1982 Neumann
4,343,572 A * 8/1982 Hilfiker ..... 405/284
4,391,557 A 7/1983 Hilfiker
4,411,255 A 10/1983 Lee
4,470,728 A 9/1984 Broadbent
4,505,621 A * 3/1985 Hilfiker et al. ..... 405/284
4,514,113 A 4/1985 Neumann
4,616,959 A 10/1986 Hilfiker
4,643,618 A 2/1987 Hilfiker
4,651,975 A 3/1987 Howell
4,653,962 A 3/1987 McKittrick
4,661,023 A 4/1987 Hilfiker
4,664,552 A 5/1987 Schaaf
4,710,062 A 12/1987 Vidal
4,725,170 A * 2/1988 Davis ..... 405/286
4,834,584 A 5/1989 Hilfiker
4,856,939 A * 8/1989 Hilfiker ..... 405/284
4,914,876 A 4/1990 Forsberg
4,920,712 A 5/1990 Dean, Jr.
4,929,125 A * 5/1990 Hilfiker ..... 405/262
4,952,098 A 8/1990 Grayson
4,961,673 A 10/1990 Pagano
4,968,186 A 11/1990 Ogorchock
4,993,879 A * 2/1991 Hilfiker ..... 405/262
5,044,833 A * 9/1991 Wilfiker ..... 405/267
5,066,169 A 11/1991 Gavin
5,076,735 A 12/1991 Hilfiker
5,139,369 A 8/1992 Jaecklin
5,156,496 A 10/1992 Vidal
5,190,413 A 3/1993 Carey
5,207,038 A 5/1993 Negri
RE34,314 E 7/1993 Forsberg
5,242,249 A * 9/1993 Grayson ..... 405/286
5,257,880 A 11/1993 Janopaul
5,259,704 A * 11/1993 Orgorchock ..... 405/262
5,407,303 A * 4/1995 Manns ..... 405/262
5,417,523 A 5/1995 Scales
5,451,120 A 9/1995 Martinez-Gonzalez
5,456,554 A 10/1995 Barrett
5,474,405 A 12/1995 Anderson
D366,191 S 1/1996 Gay
5,484,235 A * 1/1996 Hilfiker et al. ..... 405/284
5,487,623 A 1/1996 Anderson
5,494,379 A 2/1996 Anderson
5,507,599 A 4/1996 Anderson
5,522,682 A 6/1996 Egan
5,525,014 A * 6/1996 Brown ..... 405/262
5,531,547 A * 7/1996 Shimada ..... 405/262
5,533,839 A 7/1996 Shimada
5,568,998 A * 10/1996 Egan et al. ..... 405/262
5,582,492 A * 12/1996 Doyle, Jr. ..... 405/262
5,622,455 A 4/1997 Anderson
5,658,096 A * 8/1997 Von Kanel ..... 405/302.4
5,702,208 A 12/1997 Hilfiker
5,713,155 A * 2/1998 Prestele ..... 47/33
5,722,799 A * 3/1998 Hilfiker ..... 405/262
5,730,559 A 3/1998 Anderson
5,733,072 A * 3/1998 Hilfiker et al. ..... 405/284
D393,989 S 5/1998 Groves
5,749,680 A * 5/1998 Hilfiker et al. ..... 405/262
5,797,706 A * 8/1998 Segrestin et al. ..... 405/262
5,807,030 A * 9/1998 Anderson et al. ..... 405/262
5,820,305 A 10/1998 Taylor
5,921,715 A * 7/1999 Rainey ..... 405/262
5,947,643 A * 9/1999 Anderson et al. ..... 405/262
5,951,209 A * 9/1999 Anderson et al. ..... 405/262
5,962,834 A * 10/1999 Markman ..... 235/385
5,965,467 A * 10/1999 Stevenson et al. ..... 442/218
5,971,699 A 10/1999 Winski
5,975,809 A 11/1999 Taylor
5,975,810 A 11/1999 Taylor
6,024,516 A 2/2000 Taylor
6,050,748 A 4/2000 Anderson
6,079,908 A * 6/2000 Anderson ..... 405/262
6,086,288 A * 7/2000 Ruel et al. ..... 405/262
D433,291 S 11/2000 Shamoon
6,186,703 B1 * 2/2001 Shaw ..... 405/262
6,280,121 B1 * 8/2001 Khamis ..... 405/284
6,336,773 B1 * 1/2002 Anderson et al. ..... 405/262
6,345,934 B1 * 2/2002 Jailloux et al. ..... 405/262
6,357,970 B1 * 3/2002 Hilfiker et al. ..... 405/302.7
6,517,293 B2 * 2/2003 Taylor et al. ..... 405/302.4
6,565,288 B1 * 5/2003 McCallion ..... 405/259.5
6,595,726 B1 * 7/2003 Egan et al. ..... 405/284
6,675,547 B1 * 1/2004 Golcheh ..... 52/741.13
6,793,436 B1 * 9/2004 Ruel et al. ..... 403/316
6,802,675 B2 * 10/2004 Timmons et al. ..... 405/284
6,854,236 B2 * 2/2005 Bott ..... 52/609
6,857,823 B1 * 2/2005 Hilfiker et al. ..... 405/262
6,874,975 B2 * 4/2005 Hilfiker et al. ..... 405/262
6,939,087 B2 * 9/2005 Ruel ..... 405/286
7,033,118 B2 * 4/2006 Hilfiker ..... 405/262
7,073,983 B2 * 7/2006 Hilfiker et al. ..... 405/262
7,270,502 B2 9/2007 Brown
7,281,882 B2 * 10/2007 Hilfiker et al. ..... 405/262
7,399,144 B2 7/2008 Kallen
D599,630 S 9/2009 Taylor
7,708,503 B2 * 5/2010 Kohel et al. ..... 405/302.7
7,722,296 B1 * 5/2010 Taylor ..... 405/262
7,891,912 B2 2/2011 Taylor
7,972,086 B2 7/2011 Taylor
7,980,790 B2 7/2011 Taylor
8,079,782 B1 * 12/2011 Hilfiker et al. ..... 405/262
2002/0044840 A1 4/2002 Taylor
2002/0067959 A1 6/2002 Thornton
2003/0213203 A1 * 11/2003 Bott et al. ..... 52/603
2003/0223825 A1 12/2003 Timmons
2004/0018061 A1 1/2004 Jannsson
2004/0161306 A1 * 8/2004 Ruel ..... 405/284
2004/0179902 A1 * 9/2004 Ruel ..... 405/284
2005/0111921 A1 * 5/2005 Taylor et al. ..... 405/262
2005/0163574 A1 7/2005 Hilfiker
2005/0260042 A1 * 11/2005 Kang ..... 405/302.7
2005/0271478 A1 * 12/2005 Ferraiolo ..... 405/284
2005/0286981 A1 * 12/2005 Robertson et al. ..... 405/284
2006/0204342 A1 * 9/2006 Hilfiker et al. ..... 405/262
2006/0204343 A1 * 9/2006 Kallen ..... 405/284
2006/0239783 A1 * 10/2006 Kallen ..... 405/284
2007/0014638 A1 1/2007 Brown
2008/0308780 A1 * 12/2008 Sloan et al. ..... 256/31
2008/0315169 A1 * 12/2008 McNeill ..... 256/1
2009/0016825 A1 * 1/2009 Taylor ..... 405/284
2009/0067933 A1 3/2009 Taylor
2009/0123238 A1 * 5/2009 Morizot et al. ..... 405/302.4
2009/0285639 A1 * 11/2009 Taylor et al. ..... 405/262
2009/0304456 A1 12/2009 Taylor
2010/0247248 A1 9/2010 Taylor
2010/0254770 A1 * 10/2010 Morizot et al. ..... 405/302.4
2011/0091290 A1 * 4/2011 Ridgway et al. ..... 405/284
2011/0170957 A1 7/2011 Taylor
2011/0170958 A1 * 7/2011 Taylor ..... 405/262
2011/0170960 A1 7/2011 Taylor

(56) References Cited

U.S. PATENT DOCUMENTS

| | | | |
|---|---|---|---|
| 2011/0229274 | A1 | 9/2011 | Taylor |
| 2011/0311317 | A1 | 12/2011 | Taylor |
| 2011/0311318 | A1 | 12/2011 | Taylor |

FOREIGN PATENT DOCUMENTS

| | | |
|---|---|---|
| FR | 530097 | 9/1921 |
| FR | 1006087 | 1/1952 |
| JP | 3114014 | 6/1991 |
| JP | 08209703 | 8/1996 |
| JP | 08326074 | 12/1996 |
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US08/069011—International Preliminary Report on Patentability dated Jan. 21, 2010.

International Application No. PCT/US10/036991—International Search Report and Written Opinion dated Aug. 2, 2010.

International Application No. PCT/US09/44099—International Preliminary Report on Patentability dated Nov. 25, 2010.

International Application No. PCT/US2010/036991—International Preliminary Examination Reported mailed Jul. 14, 2011.

International Application No. PCT/US09/0031494—International Preliminary Report on Patentability dated Jul. 19, 2011.

International Application No. PCT/US2010/036991—Corrected International Preliminary Examination Report mailed Aug. 15, 2011.

International Application No. PCT/US2011/031688—International Search Report and Written Opinion dated Nov. 30, 2011.

International Application No. PCT/US2011/040540—International Search Report and Written Opinion dated Feb. 17, 2012.

International Application No. PCT/US2011/040543—International Search Report and Written Opinion dated Feb. 21, 2012.

International Application No. PCT/US2011/040541—International Search Report and Written Opinion dated Feb. 27, 2012.

Webster's tenth edition, "Collegiate Dictionary", p. 423; 1998.

* cited by examiner

SOIL REINFORCING ELEMENT FOR A MECHANICALLY STABILIZED EARTH STRUCTURE

CROSS-REFERENCE TO RELATED APPLICATION

The present application is a continuation-in-part of co-pending U.S. patent application Ser. No. 12/837,347, entitled "Mechanically Stabilized Earth Welded Wire Facing Connection System and Method," which was filed on Jul. 15, 2010 and which was a continuation-in-part of U.S. patent application Ser. No. 12/818,011, entitled "Mechanically Stabilized Earth System and Method," and filed on Jun. 17, 2010. The contents of each priority application are incorporated herein by reference to the extent consistent with the disclosure.

BACKGROUND OF THE DISCLOSURE

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE implementation is a repetitive process where layers of backfill and horizontally-placed soil reinforcing elements are positioned one atop the other until a desired height of the earthen structure is achieved. Typically, grid-like steel mats or welded wire mesh are used as soil reinforcing elements. In most applications, the soil reinforcing elements consist of parallel, transversely-extending wires welded to parallel, longitudinally-extending wires, thus forming a grid-like mat or structure. Backfill material and the soil reinforcing mats are combined and compacted in series to form a solid earthen structure, taking the form of a standing earthen wall.

In some instances, the soil reinforcing elements can be attached or otherwise coupled to a substantially vertical wall either forming part of the MSE structure or offset a short distance therefrom. The vertical wall is typically made either of concrete or a steel wire facing and not only serves to provide tensile resistance to the soil reinforcing elements but also prevents erosion of the MSE structure. The soil reinforcing elements extending from the compacted backfill may be attached directly to a vertical wall of the facing in a variety of configurations.

Although there are several different configurations and types of soil reinforcing elements known in the art, including different materials from which they are made, it nonetheless remains desirable to find improved configurations or materials that provide greater resistance to shear forces inherent in such structures.

SUMMARY OF THE DISCLOSURE

Embodiments of the disclosure may provide a mechanically stabilized earth (MSE) structure. The MSE structure may include a vertical facing disposed adjacent an earthen formation, and a soil reinforcing element coupled to the vertical facing and extending into the earthen formation, the soil reinforcing element comprising a plurality of transverse wires coupled to at least two longitudinal wires having lead ends that converge, wherein the lead ends have deformations defined thereon. The MSE structure may further include an end connector welded to the lead ends of the longitudinal wires, the end connector being configured to couple the soil reinforcing element to the vertical facing.

Embodiments of the disclosure may further provide a method for coupling an end connector to a soil reinforcing element. The soil reinforcing element may have a plurality of transverse wires coupled to at least two longitudinal wires having lead ends that converge. The method may include placing a portion of the end connector between the lead ends of the soil reinforcing element, the soil reinforcing element defining a plurality of deformations thereon. The method may further include welding the portion of the end connector to the lead ends, whereby the plurality of deformations provides a more robust weld.

Embodiments of the disclosure may further provide a soil reinforcing element. The soil reinforcing element may include a pair of longitudinal wires extending substantially parallel to each other and having a connection end. The soil reinforcing element may further include a plurality of transverse wires coupled to the pair of longitudinal wires and laterally-spaced from each other, the pair of longitudinal wires and the plurality of transverse wires being made of positively deformed wire or bar stock. An end connector may be coupled to the connection end, thereby taking advantage of the positively deformed wire and its ability to create a more effective resistance weld.

DETAILED DESCRIPTION

Figure 1:
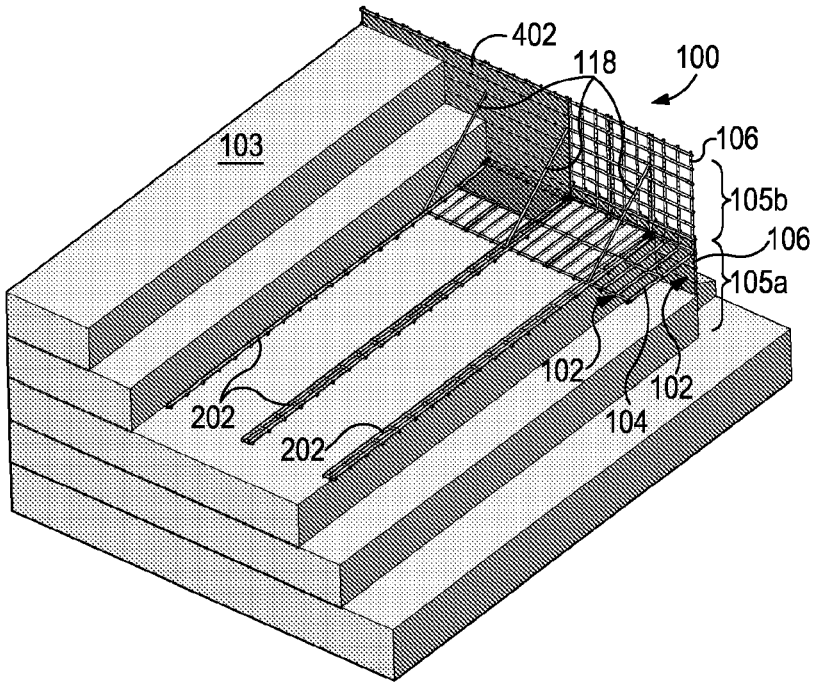
FIG. 1 is an isometric view of an exemplary system of constructing a mechanically stabilized earth structure, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 1, illustrated is an isometric view of an exemplary system 100 for erecting an MSE structure. In brief, and as will be described in more detail below, the system 100 may include one or more wire facings 102 stacked one atop the other and having one or more soil reinforcing elements 202 coupled thereto. One or more struts 118 may also be coupled to each wire facing 102 and adapted to maintain each wire facing 102 in a predetermined angular configuration. Backfill 103 may be sequentially added to the system 100 in a plurality of layers configured to cover the soil reinforcing elements 202, thereby providing tensile strength to the wire facings 102 and preventing the wire facings 102 from bulging outward. A more detailed discussion of these and other elements of the system 100 follows herewith.

Figure 2A:
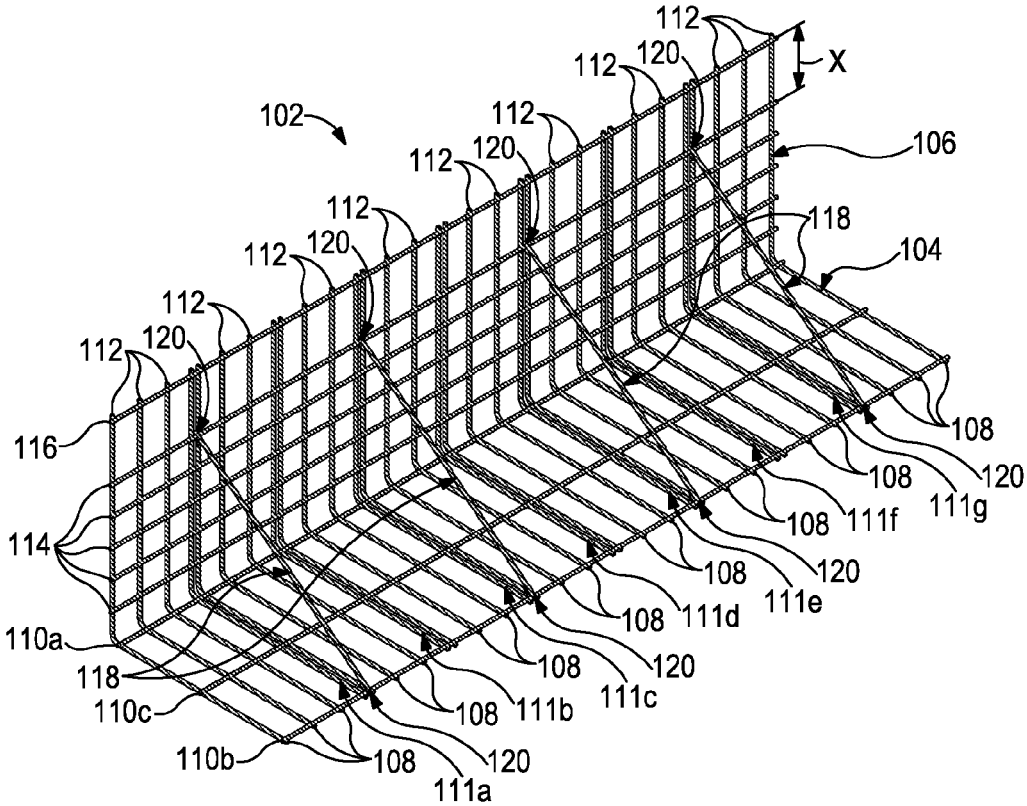
FIG. 2A is an isometric view of an exemplary wire facing element, according to one or more aspects of the present disclosure.
Figure 2B:
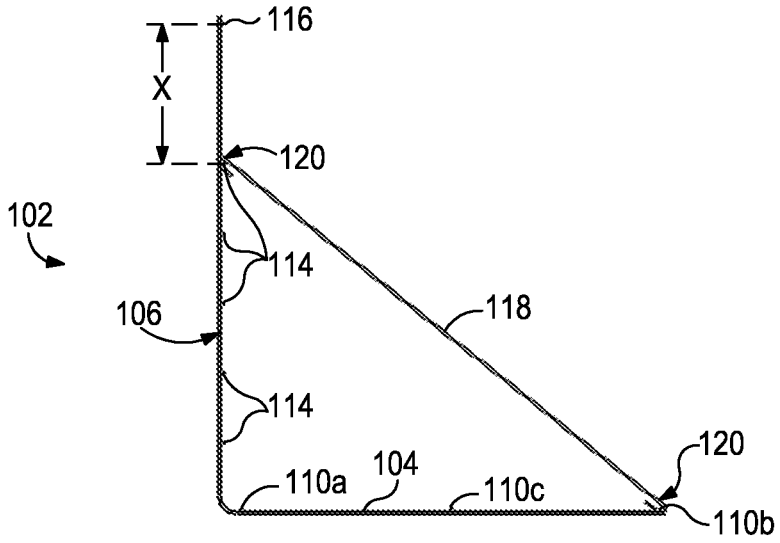
FIG. 2B is a side view of the wire facing element shown in FIG. 2A.

Referring to FIGS. 2A and 2B, each wire facing 102 of the system 100 may be fabricated from several lengths of cold-drawn wire welded and arranged into a mesh panel. The wire mesh panel can then be folded or otherwise shaped to form a substantially L-shaped assembly including a horizontal element 104 and a vertical facing 106 or wire facing. In other embodiments, the horizontal element 104 and vertical facing 106 include independent wire meshes that are coupled or otherwise attached at one end, thereby forming the substantially L-shaped assembly, The horizontal element 104 may include a plurality of horizontal wires 108 welded or otherwise attached to one or more cross wires 110, such as an initial wire 110*a*, a terminal wire 110*b*, and a median wire 110*c*. The initial wire 110*a* may be disposed adjacent to and directly behind the vertical facing 106, thereby being positioned inside the MSE structure. The terminal wire 110*b* may be disposed at or near the distal ends of the horizontal wires 108. The median wire 110*c* may be welded or otherwise coupled to the horizontal wires 108 and disposed laterally between the initial and terminal wires 110*a,b*. As can be appreciated, any number of cross wires 110 can be employed without departing from the scope of the disclosure. For instance, in at least one embodiment, the median wire 110*c* may be excluded from the system 100.

The vertical facing 106 can include a plurality of vertical wires 112 extending vertically with reference to the horizontal element 104 and laterally-spaced from each other. In one embodiment, the vertical wires 112 may be vertically-extending extensions of the horizontal wires 108. In other embodiments, as briefly discussed above, the vertical wires 112 may be independent of the horizontal wires 108 where the vertical facing 106 is independent of the horizontal element 104. The vertical facing 106 may also include a plurality of facing cross wires 114 vertically-offset from each other and welded or otherwise attached to the vertical wires 112. A top-most cross wire 116 may be vertically-offset from the last facing cross wire 114 and also attached to the vertical wires 112 in like manner.

In at least one embodiment, each vertical wire 112 may be separated by a distance of about 4 inches on center from adjacent vertical wires 112, and the facing cross wires 114 may also be separated from each other by a distance of about 4 inches on center, thereby generating a grid-like facing composed of a plurality of square voids having about a 4"×4" dimension. As can be appreciated, however, the spacing between adjacent wires 112, 114 can be varied to more or less than 4 inches to suit varying applications and the spacing need not be equidistant. In one embodiment, the top-most cross wire 116 may be vertically-offset from the last facing cross wire 114 by a distance X, as will be discussed in more detail below.

The wire facing 102 may further include a plurality of connector leads 111*a-g* extending from the horizontal element 104 and up the vertical facing 106. In an embodiment, each connector lead 111*a-g* may include a pair of horizontal wires 108 (or vertical wires 112, if taken from the frame of reference of the vertical facing 106) laterally-offset from each other by a short distance. The short distance can vary depending on the particular application, but may generally include about a one inch separation. In one embodiment, each connector lead 111*a-g* may be equidistantly-spaced from each other along the horizontal element 104 and/or vertical facing 106, and configured to provide a visual indicator to an installer as to where a soil reinforcing element 202 (FIGS. 1 and 3) may be properly attached, as will be described in greater detail below. In at least one embodiment, each connector lead 111*a-g* may be spaced from each other by about 12 inches on center. As can be appreciated, however, such relative distances may vary to suit particular applications.

Still referring to FIGS. 2A-2B, one or more struts 118 may be operatively coupled to the wire facing 102. As illustrated, the struts 118 may be coupled to both the vertical facing 106 and the horizontal element 104 at appropriate locations. Each strut 118 may be prefabricated with or include a connection device 120 disposed at each end of the strut 118 and configured to fasten or otherwise attach the struts 118 to both the horizontal element 104 and the vertical facing 106. In at least one embodiment, as can best be seen in FIG. 5, the connection device 120 may include a hook that is bent about 180° back upon itself. In other embodiments, the connection device 120 may include a wire loop disposed at each end of the struts 118 that can be manipulated, clipped, or otherwise tied to both the horizontal element 104 and the vertical facing 106. As can be appreciated, however, the struts 118 can be coupled to the horizontal element 104 and the vertical facing 106 by any practicable method or device known in the art.

Each strut 118 may be coupled at one end to at least one facing cross wire 114 and at the other end to the terminal wire 110*b*. In other embodiments, one or more struts 118 may be coupled to the median wire 110*c* instead of the terminal wire 110*b*, without departing from the scope of the disclosure. As illustrated, each strut 118 may be coupled to the wire facing 102 in general alignment with a corresponding connector lead 111*a-g*. In other embodiments, however, the struts 118 can be connected at any location along the respective axial lengths of any facing cross wire 114 and terminal wire 110*b*, without departing from the scope of the disclosure. In yet other embodiments, the struts 118 may be coupled to a vertical wire 112 of the vertical facing 106 and/or a horizontal wire 108 of the horizontal element 104, respectively, without departing from the scope of the disclosure.

The struts 118 are generally coupled to the wire facing 102 before any backfill 103 (FIG. 1) is added to the respective layer or "lift" of the system 100. During the placement of backfill 103, and during the life of the system 100, the struts 118 may be adapted to prevent the vertical facing 106 from bending or otherwise extending past a predetermined vertical angle. For example, in the illustrated embodiment, the struts 118 may be configured to maintain the vertical facing 106 at or near about 90° with respect to the horizontal element 104. As can be appreciated, however, the struts 118 can be fabricated to varying lengths or otherwise attached at varying locations along the wire facing 102 to maintain the vertical facing 106 at a variety of angles of orientation. The struts 118 may allow installers to walk on the backfill 103 of the MSE structure, tamp it, and compact it fully before adding a new lift or layer, as will be described below.

Figure 3:
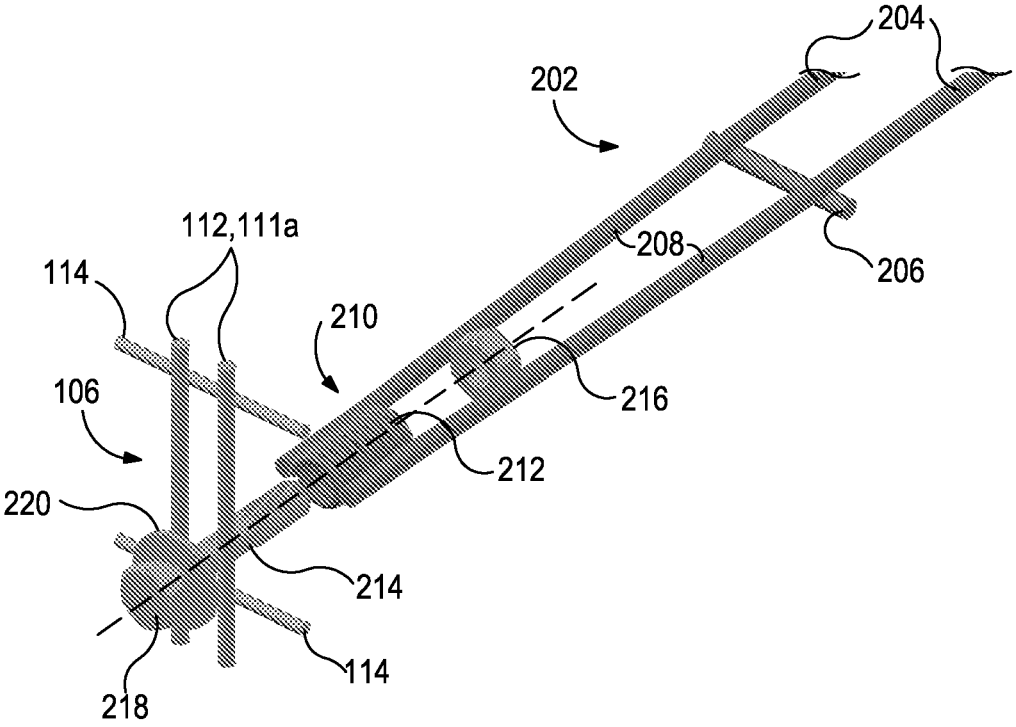
FIG. 3 is an isometric view of a soil reinforcing element used in the system shown in FIG. 1, according to one or more aspects of the present disclosure.

Referring now to FIG. 3, illustrated is an exemplary soil reinforcing element 202 that may be attached or otherwise coupled to a portion of the wire facing 102 (FIGS. 2A and 2B) in the construction of an MSE structure. The soil reinforcing element 202 may include at least two longitudinal wires 204 that extend substantially parallel to each other. The longitudinal wires 204 may be joined to one or more transverse wires 206 in a generally perpendicular fashion by welds at their intersections, thus forming a welded wire gridworks.

In one or more embodiments, lead ends 208 of the longitudinal wires 204 may generally converge and be welded or otherwise attached to a connector 210, or end connector. In at least one embodiment, the connector 210 (exploded in FIG. 3 for ease of viewing) may include a coil 212, a threaded rod 214, such as a bolt or a length of rebar, and a nut 216. As illustrated, the coil 212 may include a plurality of indentations or grooves defined along its axial length which provide a more suitable welding surface for attaching the lead ends 208 of the longitudinal wires 204 thereto. For example, where the coil 212 is resistance welded to the lead ends 208, such indentations and/or grooves can result in a stronger weld. In one embodiment, the coil 212 can be a compressed coil spring. In other embodiments, the coil 212 can be another nut or a coil rod that is welded to the longitudinal wires 204. Other exemplary embodiments of the connector 210 contemplated herein are described in co-owned U.S. Pat. No. 6,571,293, entitled "Anchor Grid Connector Element," issued on Feb. 11, 2003 and hereby incorporated by reference to the extent not inconsistent with the present disclosure.

To secure the soil reinforcing element 202 to a portion of the wire facing 102 (FIG. 2B), or more particularly the vertical facing 106, the head 218 of the threaded rod 214 may be disposed on the front side of at least two vertical wires 112, such as at a connector lead 111*a*. The body of the threaded rod 214 can be extended through the vertical facing 106 and coil 212 and secured thereto with the nut 216 at its end. As illustrated, the head 218 may be prevented from passing through the vertical wires 112 or connector lead 111*a* by employing a washer 220 disposed radially about the threaded rod and adapted to provide a biasing engagement with the vertical wires 112 or connector lead 111*a*. As the nut 216 is tightened, it brings the coil 212 into engagement, or at least adjacent to, the back side of the vertical facing 106.

In embodiments where the lateral spacing of adjacent vertical wires 112 is such that the connector 210 and a portion of the soil reinforcing element 202 may be able to extend through the vertical facing 106, it is further contemplated to employ secondary washers or bearing plates (not shown) on the inside or back side of the vertical facing 106. For instance, at least one secondary washer or bearing plate may extend radially around the threaded rod and be disposed axially adjacent the coil 212 and large enough so as to bear on at least two vertical wires 112 and prevent the connector 210 and lead ends 208 from passing through the vertical facing 106. Accordingly, the soil reinforcing element 202 may be secured against removal from the wire facing 102 on both front and back sides of the vertical facing 106.

Figure 4:
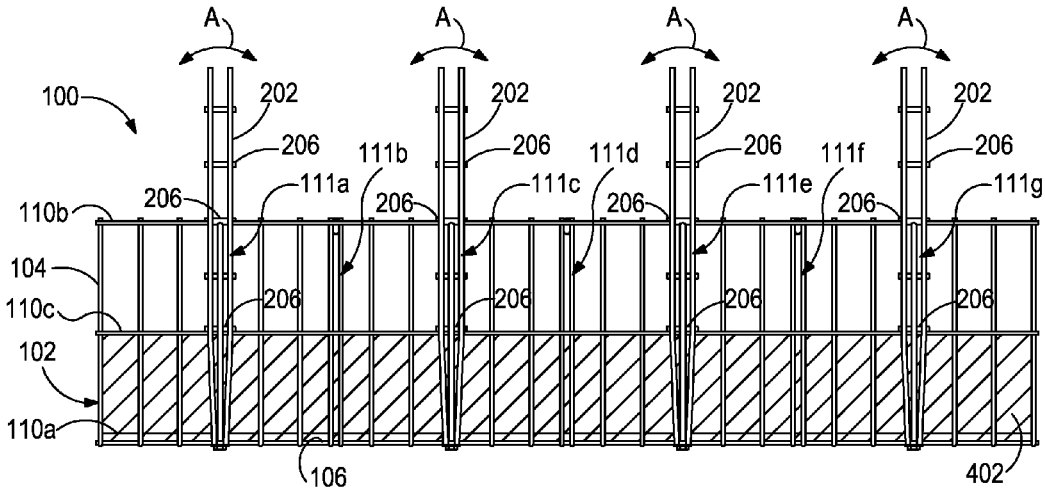
FIG. 4 is a plan view of the system of constructing a mechanically stabilized earth structure, according to one or more aspects of the present disclosure.

Referring to FIG. 4, depicted is a plan view of the system 100 where at least four soil reinforcing elements 202 have been coupled to a wire facing 102. As illustrated, the soil reinforcing elements 202 may be attached to the wire facing 102 at one or more connector leads 111*a-g*. In one or more embodiments, soil reinforcing elements 202 may be connected to each connector lead 111*a-g*, every other connector lead 111*a-g*, every third connector lead 111*a-g*, etc. For instance, FIG. 4 depicts soil reinforcing elements 202 connected to every other connector lead 111*a*, 111*c*, 111*e*, and 111*g*.

In one or more embodiments, the terminal wire 110*b* and/or median wire 110*c* may be located at a predetermined distance from the initial wire 110*a* to allow at least one transverse wire 206 of the soil reinforcing element 202 to be positioned adjacent the terminal and/or median wires 110*b*, 110*c* when the soil reinforcing element 202 is tightened against the wire facing 102 with the connector 210. Accordingly, corresponding transverse wires 206 may be coupled or otherwise attached to the terminal and/or median wires 110*b*, 110*c*. The transverse wires 206 may be positioned either directly behind or in front of the terminal and/or median wires 110*b*, 110*c* and secured thereto using a coupling device (not shown), such as a hog ring, wire tie, or the like. In yet other embodiments, the soil reinforcing element 202 is secured to only one or none of the terminal and/or median wires 110*b*, 110*c*.

In embodiments where the soil reinforcing element 202 is not coupled to the terminal or median wires 110*b*, 110*c*, it may be free to swivel or otherwise rotate in a horizontal plane as generally indicated by arrows A. As can be appreciated, this configuration allows the soil reinforcing elements 202 to swivel in order to avoid vertically-disposed obstructions, such as drainage pipes, catch basins, bridge piles, or bridge piers, which may be encountered in the backfill 103 (FIG. 1) field.

As shown in both FIGS. 1 and 4, the system 100 may further include a screen 402 disposed on the wire facing 102 once the soil reinforcing elements 202 have been connected as generally described above. In one embodiment, the screen 402 can be disposed on portions of both the vertical facing 106 and the horizontal element 104. As illustrated, the screen 402 may be placed on substantially all of the vertical facing 106 and only a portion of the horizontal element 104. In other embodiments, however, the screen 402 may be arranged on the wire facing 102 in different configurations, such as covering the entire horizontal element 104 or only a portion of the vertical facing 106. In operation, the screen 402 may be configured to prevent backfill 103 (FIG. 1) from leaking, eroding, or otherwise raveling out of the wire facing 102. In one embodiment, the screen 402 may be a layer of filter fabric. In other embodiments, however, the screen 402 may include construction hardware cloth or a fine wire mesh. In yet other embodiments, the screen 402 may include a layer of cobble, such as large rocks that will not advance through the square voids defined in the vertical facing 106, but which are small enough to prevent backfill 103 materials from penetrating the wire facing 102.

Referring again to FIG. 1, the system 100 can be characterized as a lift 105 configured to build an MSE structure wall to a particular required height. As illustrated in FIG. 1, a plurality of lifts (e.g., lifts 105*a* and 105*b*) may be required to reach the required height. Each lift 105*a,b* may include the elements of the system 100 as generally described above in FIGS. 2A, 2B, 3, and 4. While only two lifts 105*a,b* are shown in FIG. 1, it will be appreciated that any number of lifts may be used to any number of applications and reach a desired height for the MSE structure. As depicted, the first lift 105*a* may be disposed generally below the second lift 105*b* and the horizontal elements 104 of each lift 105*a,b* may be oriented substantially parallel to and vertically-offset from each other. The angle of orientation for the vertical facings 106 of each lift 105*a,b* may be similar or may vary, depending on the application. For example, the vertical facings 106 of each lift 105*a,b* may be disposed at angles less than or greater than 90° with respect to horizontal.

In at least one embodiment, the vertical facings 106 of each lift 105*a,b* may be substantially parallel and continuous, thereby constituting an unbroken vertical ascent for the facing of the MSE structure. In other embodiments, however, the vertical facings 106 of each lift 105*a,b* may be laterally offset from each other. For example, the disclosure contemplates embodiments where the vertical facing 106 of the second lift 105*b* may be disposed behind or in front of the vertical facing 106 of the first lift 105*a*, and so on until the desired height of the MSE wall is realized.

In one or more embodiments, because of the added strength derived from the struts 118, each lift 105*a,b* may be free from contact with any adjacent lift 105*a,b*. Thus, in at least one embodiment, the first lift 105*a* may have backfill placed thereon up to or near the vertical height of the vertical facing 106 and compacted so that the second lift 105*b* may be placed completely on the compacted backfill of the first lift 105*a* therebelow. Whereas conventional systems would require the vertical facing 106 of the first lift 105*a* to be securely fastened to the vertical facing 106 of the second lift 105*b* to prevent its outward displacement, the present disclosure allows each lift 105*a,b* to be physically free from engagement with each other. This may prove advantageous during settling of the MSE structure. For instance, where adjacent lifts 105*a,b* are not in contact with each other, the system 100 may settle without causing adjacent lifts to bind on each other, which can potentially diminish the structural integrity of the MSE structure.

Figure 5:
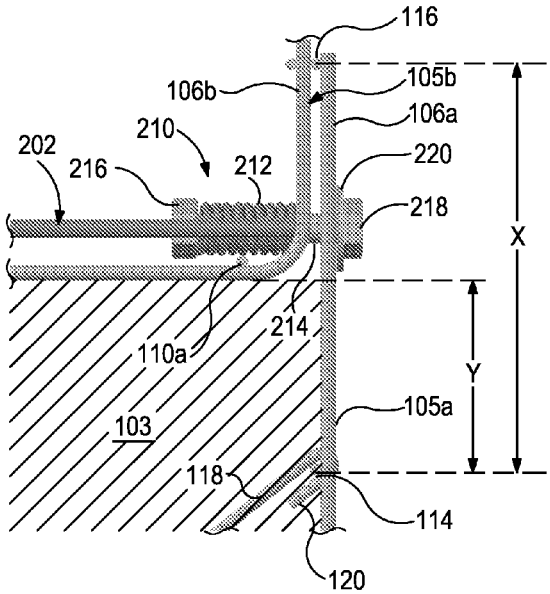
FIG. 5 is a side view of the connection apparatus for connecting at least two lifts or systems, according to one or more aspects of the present disclosure.

Referring now to FIG. 5, other embodiments of the disclosure include engaging the first and second lifts 105*a,b* in sliding engagement with one another using the connector 210 of the soil reinforcing elements 202. As shown in FIG. 5, each lift 105*a,b* may have a corresponding vertical facing 106*a*, 106*b*. The first lift 105*a* may be disposed substantially below the second lift 105*b*, with its vertical facing 106*a* being placed laterally in front of the vertical facing 106*b* of the second lift 105*b*. Backfill 103 may be added to at least a portion of the first lift 105*a* to a first height or distance Y above the last facing cross wire 114. The second lift 105*b* may be disposed on top of the backfill 103, thereby being placed a distance Y above the last facing cross wire 114. As will be appreciated, the first height or distance Y can be any distance or height less than the distance X. For example, the distance Y can be about but less than the distance X, thereby having the backfill 103 level up to but just below the top-most cross wire 116 of the vertical facing 106*a*.

In order to bring the vertical facings 106*a,b* of each lift 105*a,b* into engagement or at least adjacent one another, the threaded rod 214 of the connector 210 may be configured to extend through each vertical facing 106*a,b* and be secured with the nut 216. In order to ensure a sliding engagement between the first and second lifts 105*a,b*, the nut 216 may be "finger-tightened," or tightened so as to nonetheless allow vertical movement of either the first or second lift 105*a,b* with respect to each other. Tightening the nut 216 may bring the coil 212 into engagement with the vertical facing 106*b* of the second lift 105*b*, having the coil rest on the initial wire 110*a*, and also bring the washer 220 into engagement with the vertical facing 106*a* of the first lift 105*a*. In at least one embodiment, tightening the nut 216 may also bring the top-most cross wire 116 into engagement with the vertical facing 106*b*, thereby further preventing the outward displacement of the vertical facing 106*b*. However, in other embodiments, the top-most cross wire 116 is not necessarily brought into contact with the vertical facing 106*b*, but the vertical facing 106*b* may be held in its angular configuration by a strut 118 and connection device 120 disposed on the upper facing cross wire 114 of the vertical facing 106*b*.

Placing the second lift 105*b* a distance Y above the upper facing cross wire 114 allows the second lift 105*b* to vertically shift or translate the distance Y in reaction to MSE settling or thermal expansion/contraction of the MSE structure. Accordingly, the distance Y can be characterized as a settlement distance that the second lift 105*b* may be able to traverse without binding on the first lift 105*a* and thereby weakening the structural integrity of the MSE system.

Figure 6A:
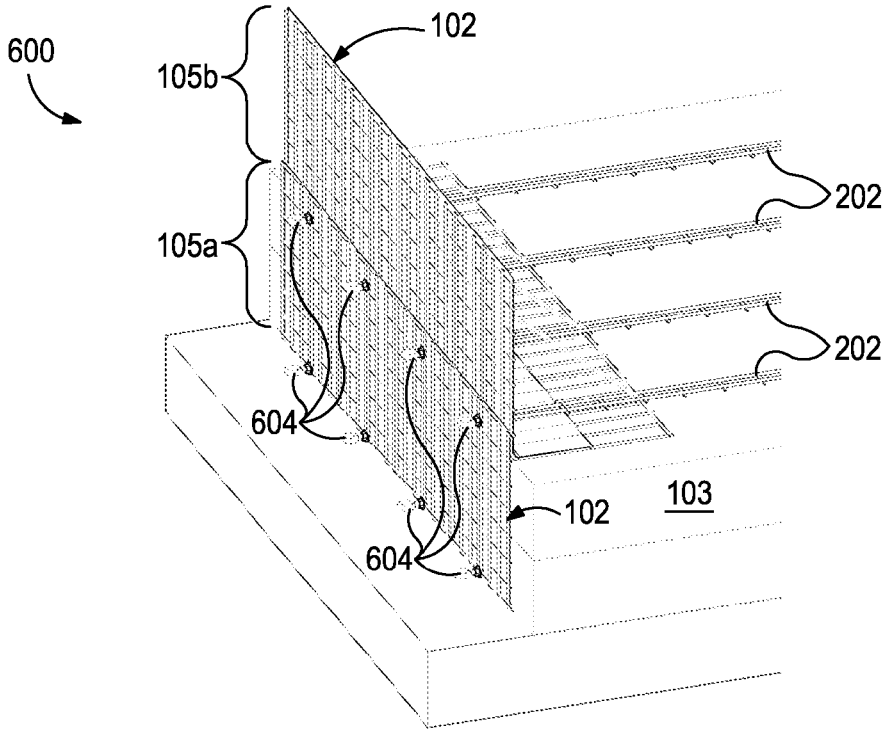
FIG. 6A is an isometric view of another system of constructing a mechanically stabilized earth structure, according to one or more aspects of the present disclosure.
Figure 6B:
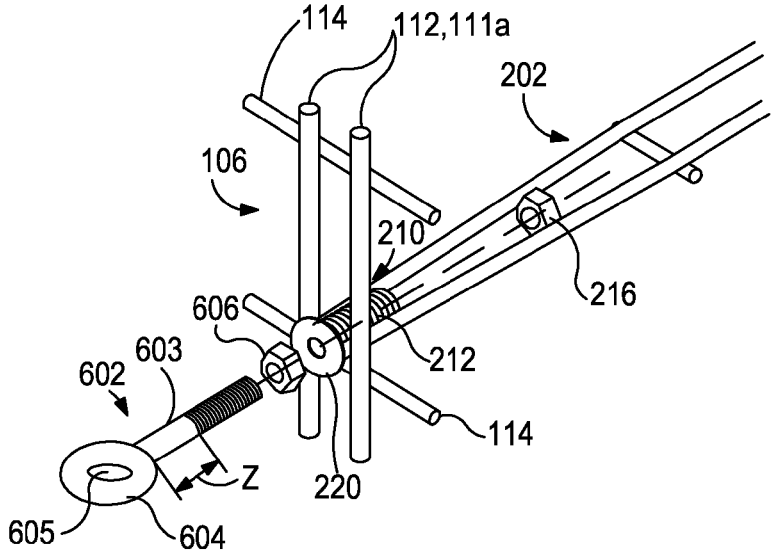
FIG. 6B is a side view of a soil reinforcing element used in the system shown in FIG. 6A, according to one or more aspects of the present disclosure.

Referring now to FIGS. 6A-6B, depicted is another exemplary embodiment of the system 100 depicted in FIG. 1, embodied and described here as system 600. As such, FIGS. 6A-6B may best be understood with reference to FIGS. 1-5, wherein like numerals correspond to like elements and therefore will not be described again in detail. Similar to the system 100 generally described above, system 600 may include one or more lifts 105*a,b* stacked one atop the other and having one or more soil reinforcing elements 202 coupled the wire facings 102. The soil reinforcing elements 202 extend into the backfill 103 which is sequentially added to the system 600 in a plurality of layers configured to cover the soil reinforcing elements 202 and provide tensile strength to each wire facing 102.

The soil reinforcing elements 202 in system 600, however, may include a different type of connector 210 than that described in system 100 in FIG. 3 above. For example, any type of threaded rod can be extended through the coil 212 and secured thereto with a nut 216, thereby replacing the threaded rod 214 as generally described with reference to FIG. 3. Referring to the exploded view of the connector 210 in FIG.

6B, a threaded eye-bolt 602 with a head 604 may be employed. As illustrated, the head 604 may be a loop defining an aperture 605 therein. To secure the soil reinforcing element 202 to a portion of a wire facing 102, or in particular the vertical facing 106 thereof, the head 604 of the eye-bolt 602 may be disposed on the front side of at least two vertical wires 112, such as at a connector lead 111*a*, such that the body of the eye-bolt 602 can be extended through the coil 212 and secured thereto with the nut 216. As illustrated, the loop or head 604 may be prevented from passing through the vertical wires 112 or connector lead 111*a* by employing a washer 220 adapted to provide a biasing engagement with the vertical wires 112 or connector lead 111*a* on the front side surface of the vertical facing 106. As the nut 216 is tightened, it brings the coil 212 into engagement or at least adjacent to the back side of the vertical facing 106, and the washer 220 into engagement with the vertical wires 112 or connector lead 111*a* at the front side.

In one or more embodiments, the body of the eye-bolt 602 may also be threaded through a second nut 606 adapted to be disposed against the washer 220 on the outside of the vertical facing 106. As illustrated, the body of the eye-bolt 602 can have a non-threaded portion 603 configured to offset the second nut 606 from the head 604 a distance Z when the second nut 606 is fully threaded onto the body. This may allow the head 604 to be laterally-offset a short distance from the vertical facing 106, as shown in FIG. 6A.

As can be appreciated, having the head 604 offset from the vertical facing 106 may provide an attachment means for a laterally offset facing, such as a facing used in two-stage MSE applications. Examples of two-stage MSE applications include co-owned U.S. patent application Ser. No. 12/132,750, entitled "Two Stage Mechanically Stabilized Earth Wall System," filed Jun. 4, 2008, and U.S. patent application Ser. No. 13/012,607, entitled "Two Stage Mechanically Stabilized Earth Wall System," filed Jan. 24, 2011, the contents of each application are hereby incorporated by reference to the extent consistent with the present disclosure. As illustrated, the loop or head 604 may be horizontally-disposed, but may also be vertically-disposed without departing from the scope of the disclosure.

Figure 7:
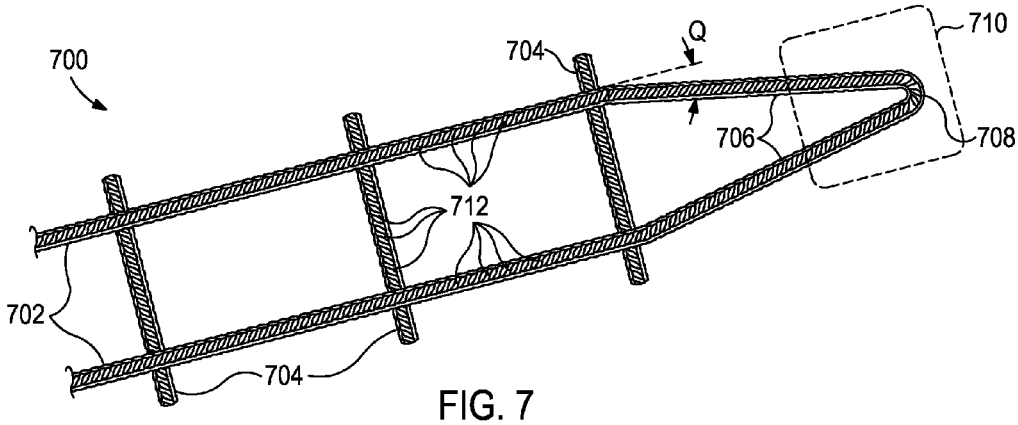
FIG. 7 is an isometric view of an exemplary soil reinforcing element, according to one or more aspects of the present disclosure.

Referring now to FIG. 7, illustrated is an exemplary soil reinforcing element 700, according to one or more embodiments disclosed. The soil reinforcing element 700, and those disclosed in FIGS. 8 and 9 below, may be used in exemplary mechanically stabilized earth structures, such as those described herein. Similar to the soil reinforcing element 202 described with reference to FIG. 3 above, the soil reinforcing element 700 may generally include a welded wire grid made of a metal material and having a pair of longitudinal wires 702 that are disposed substantially parallel to each other and extend horizontally into the backfill 103 (FIGS. 1 and 6A). In some embodiments, there may be more that two longitudinal wires 702. The longitudinal wires 702 are joined together by a plurality of transverse wires 704 laterally—offset from each other along the length of the longitudinal wires 702. In one embodiment, the transverse wires 704 may be arranged generally perpendicular to the longitudinal wires 702, but other angles of relative configuration are also contemplated herein without departing from the scope of the disclosure.

The transverse wires 704 may be coupled to the longitudinal wires 702 by welds or other suitable attachment means at their intersections. The spacing between each longitudinal wire 702 may be about 2 inches, while the spacing between each transverse wire 704 may be about 6 inches. As can be appreciated, however, the spacing and configuration of adjacent respective wires 702, 704 may vary for a variety of reasons, such as the combination of tensile force requirements that the soil reinforcing element 700 must endure and resist.

Each longitudinal wire 702 may have a lead end 706 that generally converges toward an adjacent lead end 706. Although a specific angle of convergence Q of the lead ends 706 is shown in FIG. 7, it will be appreciated that any angle of convergence Q of the lead ends 706 may be employed without departing from the scope of the disclosure. In one embodiment, the lead ends 706 converge and terminate at a wall end 708 or a connection end. The wall end 708 may be configured to receive or otherwise be attached to an end connector 710 adapted to attach the soil reinforcing element 700 to a variety of types of vertical facings (not shown), such as a wire facing, a concrete facing, or a sheet metal facing. Once appropriately secured to the vertical facing and compacted within the backfill 103 (FIGS. 1 and 6A), the soil reinforcing element 700 provides tensile strength to the vertical facing and prevents any outward movement and shifting thereof.

The end connector 710 is illustrated as a dashed box since there are numerous end connectors 710 that may be used in conjunction with the soil reinforcing element 700, without departing from the scope of the disclosure.

The soil reinforcing element 700 may be made of lengths of wire or bar stock that define numerous deformations 712 on the surface thereof. In one embodiment, the deformations 712 are positively defined and extend radially-outward from the surface of each wire 702, 704. The positive deformations 712 may be formed by cold-forming processing, which increases the strength of the wires 702, 704 via strain hardening. Consequently, the positive deformations 712 provide higher tensile capacity yield strength. For example, the tensile capacity of a soil reinforcing element having smooth wires 702, 704 is about 65 ksi, while positively deformed wires 702, 704 provide a tensile capacity that is about 20% greater, or about 80 ksi.

In other embodiments, the deformations 712 are negatively defined and extend radially-inward from the surface of each wire 702, 704. Wires 702, 704 having negative deformations 712 may include lengths of rebar or similar types of bar stock. Whether positively or negatively defined, however, the deformations 712 also serve to increase the pull-out capacity of the soil reinforcing element 700, whereby it becomes more difficult to pull the soil reinforcing element 700 through compacted soil in the backfill 103 (FIGS. 1 and 6A).

Figure 8:
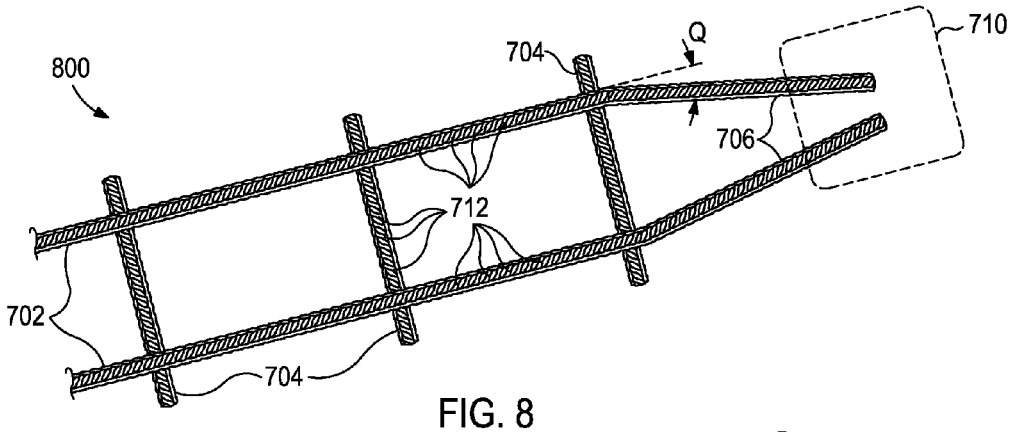
FIG. 8 is an isometric view of another exemplary soil reinforcing element, according to one or more aspects of the present disclosure.

Referring now to FIG. 8, illustrated is another soil reinforcing element 800, according to one or more embodiments of the disclosure. The soil reinforcing element 800 may be similar in some respects to the soil reinforcing element 700 of FIG. 7. Accordingly, the soil reinforcing element 800 may be best understood with reference to FIG. 7, where like numerals designate like elements that will not be described again in detail. Unlike the soil reinforcing element 700 of FIG. 7, the soil reinforcing element 800 has a connection end where the lead ends 706 converge but are not coupled directly to each other. Instead, the lead ends 706 provide an area where an end connector 710 may be coupled thereto.

The deformations 712 defined in the surface of the lead ends 706 provide a more effective resistance weld to the end connector 710. For example, the deformations 712 allow the metal in the soil reinforcing element 800 to puddle quicker, thereby requiring less heat and less pressure to generate a solid resistance weld to the end connector 710. Moreover, having deformations 712 defined on the lead ends 706 may eliminate the need to have grooves or indentations on the end connector 710, such as the grooves and indentations shown on the coil 212 in FIGS. 3 and 6B. Nonetheless, the end connector 710 may also have grooves or indentations defined thereon, without departing from the scope of the disclosure. Accordingly, one of the end connectors 710 that could be attached to the soil reinforcing element 800 is the connector 210 shown and described in FIGS. 3 and 6B.

It will be appreciated that several other types of end connectors 710 may also be coupled to the lead ends 706 of the soil reinforcing element 800. For example, the connection stud disclosed in co-owned U.S. patent application Ser. No. 12/479,488 entitled "Mechanically Stabilized Earth Connection Apparatus," filed Jun. 5, 2009 and incorporated herein by reference to the extent not inconsistent with the present disclosure, may be a suitable end connector 710. The connection stud may include a cylindrical body bent to about a 90° angle relative to horizontal, thus forming a vertical portion. The vertical portion may terminate at a head that is noticeably larger than the diameter or cross-section of the vertical portion. The tail end of the body may include indentations or thread markings capable of enhancing the resistance weld to the lead ends 706.

The connection studs disclosed in co-owned U.S. patent application Ser. No. 12/756,898 entitled "Retaining Wall Soil Reinforcing Connector and Method," filed Apr. 8, 2010 and incorporated herein by reference to the extent not inconsistent with the present disclosure, may also be a suitable end connector 710. One disclosed connection stud is created from a one-piece forging process and has a tab that extends from its stem. The stem may be either convex or concave longitudinally and include a plurality of indentations, grooves, or threads defined along its axial length, either cast or otherwise machined into the stem. Another disclosed connection stud is a loop-type connection stud where the tab is generally replaced with a loop or ring. The stem can define axial channels disposed along opposing sides of its axial length, and having a plurality of grooves cast in or otherwise machined therein. Yet another disclosed connection stud is a dual-prong connection stud, where the tab is replaced with a pair of prongs vertically offset from each other and extending axially from the stem. Each prong may define a centrally-disposed perforation, coaxially aligned with each other, and used for connecting the dual-prong connection stud to a facing anchor, for example.

The connection stud disclosed in co-owned U.S. patent application Ser. No. 12/818,011 entitled "Mechanically Stabilized Earth System and Method," filed Jun. 17, 2010 and incorporated herein by reference to the extent not inconsistent with the present disclosure, may also be a suitable end connector 710. The connection stud may include a stem and a connector, where the stem includes a plurality of indentations or grooves defined along its axial length and the connector may be hook-shaped or otherwise turned about 180° from the axial direction of the stem.

Figure 9:
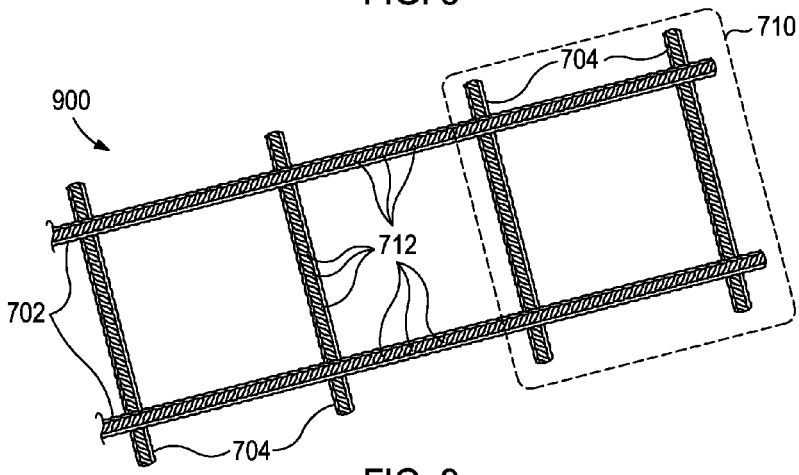
FIG. 9 is an isometric view of another exemplary soil reinforcing element, according to one or more aspects of the present disclosure.

Referring now to FIG. 9, illustrated is another soil reinforcing element 900, according to one or more embodiments of the disclosure. The soil reinforcing element 900 may also be similar in some respects to the soil reinforcing element 700 of FIG. 7. Accordingly, the soil reinforcing element 900 may be best understood with reference to FIG. 7, where like numerals designate like components that will not be described again in detail. Unlike the soil reinforcing elements 700, 800 described above, the soil reinforcing element 900 does not have lead ends that converge, but instead the longitudinal wires 704 remain generally parallel to each other along their entire length. Accordingly, the end connector 710 that attaches the soil reinforcing element 900 to a vertical facing is a different configuration.

For example, the facing anchor assembly disclosed in co-owned U.S. patent application Ser. No. 12/684,479 entitled "Wave Anchor Soil Reinforcing Connector and Method," filed Jan. 8, 2010 and incorporated herein by reference to the extent not inconsistent with the present disclosure, may be a suitable end connector 710. The facing anchor assembly may include a pair of plates that are horizontally-disposed from each other and have a vertically-disposed tab at one end and define a trough at the other end. Interposed between the tab and the trough of each plate may be at least two longitudinally-offset transverse protrusions for capturing and seating at least two transverse wires 704. Another facing anchor assembly includes a one-piece device capable of receiving and securely seating at least one transverse wire 704, and simultaneously connecting to at least one horizontal wire of a vertical wire facing. The facing anchor may include a first side and a second side connected by a connecting member at one end, wherein the connecting member may includes a 180° turn in the facing anchor to define a gap between the first and second sides.

In other embodiments, the soil reinforcing element 900 may have upwardly extending extensions (not shown) disposed at its lead end. Such embodiments are described in co-owned U.S. patent application Ser. No. 12/861,632 entitled "Soil Reinforcing Connector and Method of Constructing a Mechanically Stabilized Earth Structure," filed Aug. 23, 2010 and incorporated herein by reference to the extent not inconsistent with the present disclosure. As described in the incorporated application, the upwardly extending extensions of the soil reinforcing element 900 may be coupled to a vertical wire facing using a connection device. The connection device includes a bearing plate having one or more longitudinal protrusions configured to seat the upwardly-extending extensions of the soil reinforcing element 900. The bearing plate may be configured to receive a threaded rod via a centrally-defined perforation. The rod may be extensible through the perforation and further through any adjacent vertical facings, and secured from removal by threading a nut onto its end.

In yet other embodiments, the end connector 710 may include a splice such as that disclosed in co-owned U.S. patent application Ser. No. 12/887,907 entitled "Splice for a Soil Reinforcing Element or Connector," filed Sep. 22, 2010 and incorporated herein by reference to the extent not inconsistent with the present disclosure. The splice may be used to lengthen the soil reinforcing element by coupling it to another soil reinforcing element or grid strip. The splice includes one or more wave plates, each wave plate including one or more transverse protrusions longitudinally-offset from each other and configured to receive one or more transverse wires 704 therein. Co-axially defined apertures in each wave plate are used to secure the wave plates together.

It will be appreciated by those skilled in the art that several different types of end connectors 710 (not specifically disclosed herein) may be used with the soil reinforcing elements 700, 800, 900 described herein, without departing from the scope of the disclosure.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A mechanically stabilized earth structure, comprising:

a wire facing having a bend formed therein to form a horizontal element and a vertical facing, the vertical facing disposed adjacent an earthen formation and the horizontal element extending into the earthen formation, wherein the vertical facing comprises a plurality of vertical wires and a plurality of connector leads, each connector lead of the plurality of connector leads comprising two vertical wires of the plurality of vertical wires, the two vertical wires being laterally offset from each other by a short distance;

a soil reinforcing element detachably coupled to the vertical facing and extending into the earthen formation, the soil reinforcing element comprising a plurality of transverse wires coupled to at least two longitudinal wires having lead ends that converge, wherein the lead ends have deformations defined thereon; and an end connector welded to the lead ends of the longitudinal wires, the end connector being configured to detachably couple the soil reinforcing element to the vertical facing between the two vertical wires of a connector lead of the plurality of connector leads such that at least a portion of the soil reinforcing element extends beyond an end portion of the horizontal element.

2. The structure of claim 1, wherein the soil reinforcing element is made of metal and the deformations are defined on the entire soil reinforcing element.

3. The structure of claim 1, wherein the deformations are positively deformed deformations.

4. The structure of claim 3, wherein the positively deformed deformations are derived from cold-forming processing.

5. The structure of claim 1, wherein the deformations are negatively deformed deformations.

6. The structure of claim 5, wherein the soil reinforcing element is made from rebar.

7. The structure of claim 1, wherein the end connector is resistance welded to the lead ends.

8. The structure of claim 4, wherein the end connector comprises grooves configured to enhance the resistance weld.

9. The structure of claim 1, wherein the end connector comprises a coil.

10. The structure of claim 9, wherein the end connector further comprises:

a threaded rod configured to extend through both the vertical facing and the coil, wherein a washer engages the vertical facing and prevents the threaded rod from passing completely therethrough; and a nut threaded onto the threaded rod to prevent a removal of the threaded rod from the coil, thereby detachably coupling the soil reinforcing element to the vertical facing.

* * * * *